US008366724B2

(12) United States Patent
Poran

(10) Patent No.: US 8,366,724 B2
(45) **Date of Patent: *Feb. 5, 2013**

(54) HAIR REMOVAL SYSTEM

(75) Inventor: Yehuda Poran, Hazor Haglilit (IL)

(73) Assignee: Epilady 2000 LLC, Hatzor Haglilit (IL)

( * ) Notice: Subject to any disclaimer, the term of this patent is extended or adjusted under 35 U.S.C. 154(b) by 0 days.

This patent is subject to a terminal disclaimer.

(21) Appl. No.: 12/407,157

(22) Filed: Mar. 19, 2009

(65) Prior Publication Data

US 2009/0182349 A1 Jul. 16, 2009

Related U.S. Application Data

(63) Continuation of application No. 10/876,842, filed on Jun. 28, 2004, now Pat. No. 7,597,696.

(30) Foreign Application Priority Data

Dec. 21, 2003 (IL) ..... 159483

(51) Int. Cl.
*A61B 17/50* (2006.01)

(52) U.S. Cl. ..... 606/133

(58) Field of Classification Search ..... 606/131, 606/133, 134, 36, 43; 452/71, 82–85, 102–103; 19/2; 69/26

See application file for complete search history.

(56) References Cited

U.S. PATENT DOCUMENTS

| | | | |
|---|---|---|---|
| 4,935,024 | A | 6/1990 | Dolev |
| 5,057,115 | A | 10/1991 | Dolev |
| 5,084,055 | A | 1/1992 | Demeester |
| 5,100,413 | A | 3/1992 | Doley |
| 5,108,410 | A | 4/1992 | Iwasaki et al. |
| 5,112,341 | A | 5/1992 | Doley |
| 5,190,559 | A | 3/1993 | Gabion et al. |
| 5,196,021 | A | 3/1993 | Kabla |
| 5,197,969 | A | 3/1993 | Visscher et al. |

(Continued)

FOREIGN PATENT DOCUMENTS

| | | |
|---|---|---|
| EP | 0513900 A2 | 11/1992 |
| JP | 4-5908 | 1/1992 |

(Continued)

OTHER PUBLICATIONS

Remington Smooth & Silky Hair Removal System, Use and Care Guide (2001).

(Continued)

*Primary Examiner* — Gary Jackson
*Assistant Examiner* — Lindsey Bachman
(74) *Attorney, Agent, or Firm* — Stein McEwen, LLP

(57) ABSTRACT

A device for removing hair includes a housing and a shaving head fixedly positioned in the housing. The shaving head includes generally disk-like depilator assemblies mounted on a shaft. Each of the assemblies includes a disk includes sloping regions on faces of the disk between lobes of the disk, pressure-transferring protrusions, and a rotation-transferring protrusion elements on the faces, a spacer disposed on the faces to prevent an accumulation of debris and/or to allow for periodic tilting of the disk so as to force the pressure transferring portion to press a pincer of an adjacent disc. A recess in one of the faces accommodates a one rotation-transferring protrusion of another adjacent disk to transfer a rotational force therebetween. Pincers are disposed between the lobes at the sloping portions and tilt about an axis according to contact with the pressure-transferring protrusions of the adjacent disk.

14 Claims, 14 Drawing Sheets

U.S. PATENT DOCUMENTS

| | | | | |
|---|---|---|---|---|
| 5,234,442 | A | | 8/1993 | Schäfer et al. |
| 5,281,233 | A | * | 1/1994 | Dolev ..... 606/133 |
| 5,312,419 | A | | 5/1994 | Garenfeld et al. |
| 5,462,557 | A | | 10/1995 | Jordan et al. |
| 5,797,925 | A | | 8/1998 | Heintke |
| 5,857,903 | A | | 1/1999 | Ramspeck et al. |
| 5,976,157 | A | * | 11/1999 | Yiu ..... 606/133 |
| 6,676,670 | B1 | | 1/2004 | Dolev |
| 6,824,461 | B1 | | 11/2004 | Dolev |

FOREIGN PATENT DOCUMENTS

| | | |
|---|---|---|
| WO | WO 91/03964 | 4/1991 |

OTHER PUBLICATIONS

Philips Journal, pp. 18-19 (1999).

U.S. Appl. No. 10/876,842, filed Jun. 2004, Yehuda Poran, Epilady 2000 L.L.C.

* cited by examiner

HAIR REMOVAL SYSTEM

CROSS-REFERENCE TO RELATED APPLICATION

This application is a continuation of application Ser. No. 10/876,842 filed on Jun. 28, 2004, now U.S. Patent No. 7,597,696, which claims priority from Israeli Patent Application No. 159,483, filed Dec. 21, 2003 in the Israeli Patent Office, the disclosure of which is incorporated herein by reference.

BACKGROUND OF THE INVENTION

1. Field of the Invention

The present invention relates to a hair removal system, and more particularly, to a hair removing system using a depilating device.

2. Description of the Related Art

Depilating devices use one of two methods for removing hair. In one method, the hair is cut, leaving the roots intact beneath the skin surface. In the other method, sometimes referred to as epilation, hair is removed by pulling it out from its roots.

There are several mechanisms for removing hair according to the other method. Disk mechanisms are often used. In general, these disk mechanisms include disks and associated pincer-like elements. When two pincer-like elements are brought close together, hair is trapped between the pincer elements. The discs, which rotate and produce a torque, then uproot the hair trapped between their associated pincers. The pincer-like elements and their associated disks move in unison and all pincer-like elements within a fixed distance move close to their adjacent pincer-like elements synchronously. The forces required in such mechanisms are multiples of the number of the pincers. In some of these depilatory devices, the disk mechanisms have cylindrical shapes.

Other depilating devices use disc mechanisms employ a large spring with bearings connected to its ends. In such devices, the spring presses on the bearings producing a constant force which acts identically over all the disks and their associated pincer-like elements. The magnitude of the force is the same throughout the entire mechanism. The forces required in such mechanisms are relatively small and the energy required is not great.

Several of the proposed disk hair removal systems involve the use of tilted disks which come together at a point to grasp one or more strands of hair. Other disk mechanisms involve the use of cams to alternately bring the disks together and apart, thereby trapping strands of hair. Various such disk mechanisms are discussed in U.S. Pat. No. 4,935,024 to Dolev, U.S. Pat. No. 5,057,115 to Dolev, U.S. Pat. No. 5,190,559 to Gabion, et al, U.S. Pat. No. 5,797,925 to Heintke, U.S. Pat. No. 5,857,903 to Ramspeck, et al, U.S. Pat. No. 5,312,419 to Garenfeld, et al, U.S. Pat. No. 5,196,021 to Kabla, U.S. Pat. No. 5,281,233 to Dolev, and U.S. Pat. No. 5,462,557 to Jordan, et al.

A depilatory device using a disk mechanism is subject to several constraints. The pincer-like elements associated with each disk must close quickly. The pressure exerted by each contacting pair of the pincers must be neither too great nor too little. In the former case where the pressure is too great, the hair would be cut. In the latter case where the pressure is too little, the hair would slide through without being pulled out at its roots. Typically, all the pincers associated with a row of disks must contact their adjacent pincers simultaneously. Lastly, the contacting mechanism must be simple, operate reliably over time, and be easy to maintain.

Presently, there is a need for a depilatory device that is easy and inexpensive to assemble and to maintain and which can uproot a greater number of hairs over a larger area than is possible using conventional devices. In addition, there is also an ongoing need for a depilating device that reduces discomfort associated with hair removal.

SUMMARY OF THE INVENTION

According to an aspect of the present invention, a depilator assembly is provided that, when aggregated into a series of such assemblies in a shaving head, provides a larger contact area for shaving.

According to an aspect of the present invention, a depilator assembly uses a disk mechanism where pincers of the assembly are more accurately brought into contact with each other.

According to an aspect of the present invention, a depilator assembly is provided that, when aggregated into a series of such assemblies in a shaving head, produces less noise than other shaving heads.

According to an aspect of the present invention, a depilator assembly is provided that, when aggregated into a series of such assemblies in a shaving head, is inexpensive to manufacture and maintain.

According to one aspect of the present invention, a depilator assembly for trapping hair to be removed includes an asymmetric disk formed of two lobes and having a first and second face, where the disk includes first and second sloping regions between the lobes with the first sloping region positioned on the first face and the second sloping region positioned on the second face, and the disk also includes two or more pressure-transferring protrusions on the first face, one or more rotation-transferring protrusions on the first face, and being displaced at a predetermined angle and distance from the at least two pressure-transferring protrusions on the first face, and two or more pressure-transferring protrusions on the second face.

According to an aspect of the present invention, the second face further includes two or more spacer elements, where the spacer elements prevent the accumulation of debris between adjacent disks and allow for periodic tilting of the disks when pressure is provided to the depilator assembly.

According to an aspect of the present invention, the second face further comprises one or more recesses configured to accommodate the one or more rotation-transferring protrusions of an adjacent disk such that a force transferring engagement is provided whereby, in response to a rotational force applied to the assembly, the one or more rotation-transferring protrusions transfers rotation to an adjacent assembly through the adjacent disk.

According to an aspect of the present invention, the depilator assembly further includes first and second pincers, where each of the pincers has a plurality of arms, with each arm having an end including a pinching surface.

According to an aspect of the present invention, the first pincer is positioned along the sloping region on the first face while the second pincer is positioned along the sloping region on the second face.

According to an aspect of the present invention, the pincers tilt synchronously in their respective sloping regions when pressure transferring protrusions from adjacent disks in adjacent depilator assemblies press on an arm of each of the pincers such that the arms contact each other and/or draw close to each other so that hair is trapped between pinching surfaces of the pincers.

In another embodiment of the assembly of the present invention, the one or more rotation-transferring protrusion are two rotation-transferring protrusions.

In yet another embodiment of the assembly of the present invention, the pincers are linear having two arms.

In additional embodiments of the present invention, the two pressure-transferring protrusions on each of the faces of the disk are positioned 180° apart.

In other embodiments of the present invention, when the pincers are linear, each of the sloping regions slopes from the center of the disk in two directions and are 180° apart from each other.

In a further embodiment of the present invention, the pressure-transferring protrusions are positioned proximate to the periphery of the asymmetric disk.

In still another embodiment of the present invention, the disk is made from a material chosen from a group consisting of plastic, metal and rubber, and the pincers are made of metal.

In some embodiments of the present invention, the pressure is provided by a spring.

In yet other embodiments of the present invention, the pressure is provided by an arcuate shaft.

In a further embodiment of the present invention, tilting of the pincers is effected along an axis running through a center of the disc, and perpendicular to the long axis of a first and second pincers.

In another aspect of the present invention, there is provided a device for removing hair which includes a housing and a shaving head, where the shaving head is fixedly positioned in the housing, and at least part of the shaving head is arranged to engage an area of the human body requiring depilation.

According to an aspect of the present invention, the shaving head includes a plurality of generally disk-like depilator assemblies mounted on a shaft.

According to an aspect of the present invention, each of the assemblies includes an asymmetric disk formed of two lobes, and the disk has a first and second face.

According to an aspect of the present invention, the disk includes a first and second sloping region between the lobes.

According to an aspect of the present invention, the first sloping region is positioned on the first face of the disk and the second sloping region is positioned on the second face of the disk.

According to an aspect of the present invention, the disk also includes two or more pressure-transferring protrusions formed and positioned on the first face and one or more rotation-transferring protrusions formed on the first face.

According to an aspect of the present invention, the one or more rotation-transferring protrusions are displaced at a predetermined angle and distance from the two or more pressure-transferring protrusions.

According to an aspect of the present invention, the second face of the disk includes two or more pressure-transferring protrusions and two or more spacer elements, where the spacer elements prevent the accumulation of debris between adjacent disks of the plurality of depilator assemblies.

According to an aspect of the present invention, the spacer elements also allow for periodic tilting of adjacent disks when a pressure-inducing element provides pressure to the plurality of assemblies.

According to an aspect of the present invention, the second face also includes one or more recesses configured to accommodate the one or more rotation-transferring protrusions of a similar disk in an adjacent depilator assembly such that a force transferring engagement is provided and in response to a rotational force applied to the assembly, the one or more rotation-transferring protrusions transfers rotation among the plurality of assemblies.

According to an aspect of the present invention, each disk assembly also includes first and second pincers, and each pincer has a plurality of arms, each arm having an end including pinching surfaces.

According to an aspect of the present invention, the first pincer is positioned along the sloping region on the first face of the disk, and the second pincer being positioned along the sloping region on the second face of the disk.

According to an aspect of the present invention, the pincers tilt synchronously in respective sloping regions when pressure-transferring protrusions from adjacent disks in adjacent assemblies periodically press on an arm of each of the pincers such that the pressure causes the arms to contact each other and/or to draw close to each other at their pinching surfaces so that hair may be trapped between surfaces of the pincers.

According to an aspect of the present invention, the device also includes a motor and gear drive in mechanical communication with the shaft, where the motor and gear drive provide a torque to the plurality of assemblies with which to uproot hairs trapped between the pinching surfaces when the pinching surfaces are brought into close proximity with each other.

In an embodiment of the present invention, the one or more rotation-transferring protrusions are two rotation-transferring protrusions.

In yet another embodiment of the present invention, the pincers are linear having two arms.

In a further embodiment of the present invention, the two pressure-transferring protrusions on each of the faces of the disk are positioned 180° apart.

In a further embodiment of the present invention, the pressure-transferring protrusions are positioned proximate to the periphery of the disk.

In another embodiment of the present invention, the disk is made from a material chosen from a group consisting of plastic, metal and rubber, and the pincers are metal.

In yet another embodiment of the present invention, each of the sloping regions slopes from the center of the disk in two directions and are dispersed 180° apart from each other.

In some embodiments of the present invention, the pressure-inducing element is a spring, and/or an arcuate shaft.

In still another embodiment of the present invention, tilting of the pincers is effected along an axis running through a center of the disc, running through its center and perpendicular to a long axis of the pincers.

In yet another embodiment of the present invention, adjacent assemblies of the plurality of assemblies have their pincers offset from each other by a predetermined number of degrees, where the offset is generally determined by the positioning and spacing of the one or more rotation-transferring protrusions in relation to the pincer axis.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the present invention will be understood and appreciated more fully from the following detailed description of the embodiments taken in conjunction with the accompanying drawings in which.

DETAILED DESCRIPTION OF EMBODIMENTS

Figure 1:
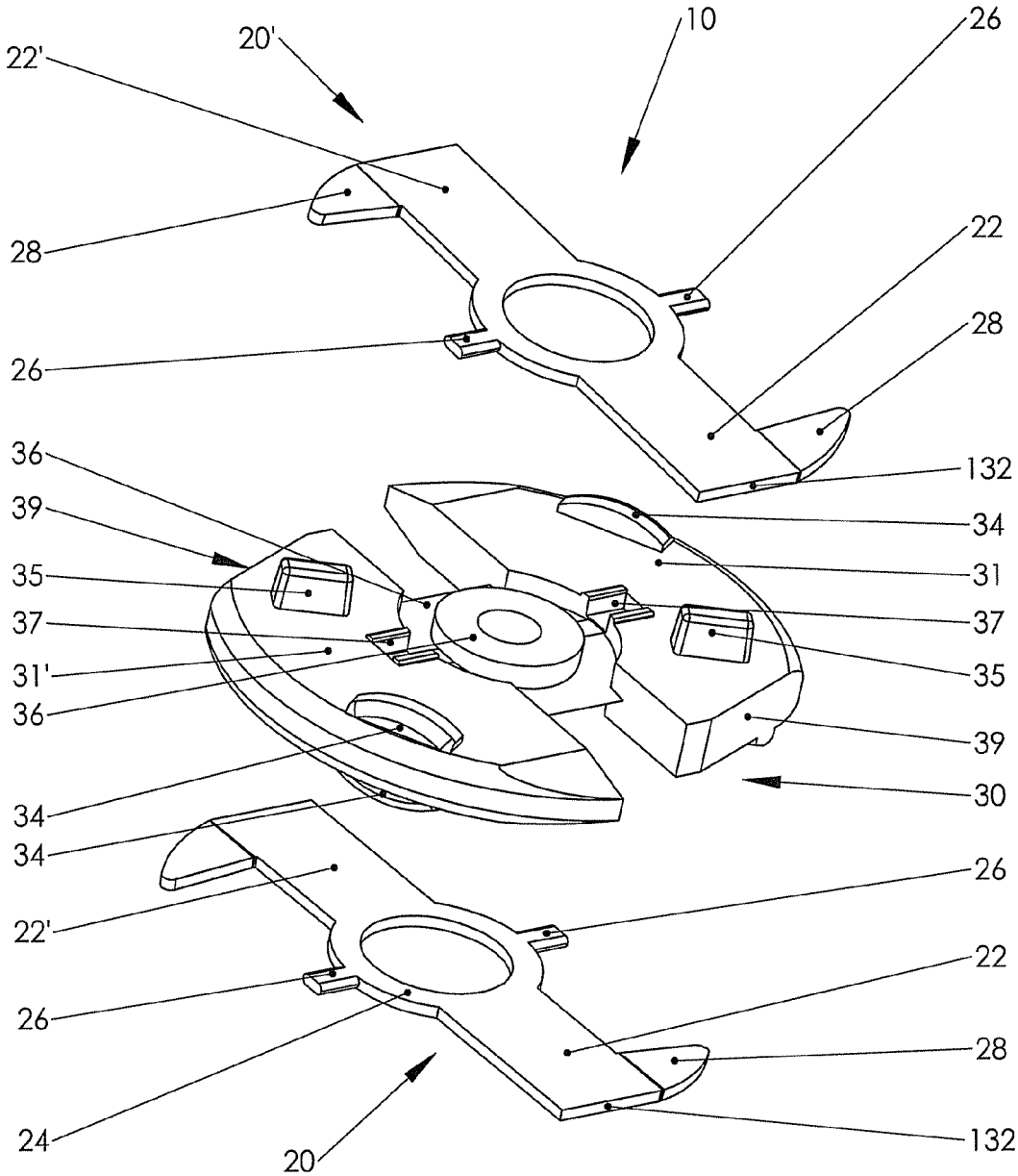
FIG. 1 is an exploded view of a depilator assembly constructed according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

The terms "contacting", "contact" and the like are used interchangeably with the terms "brought close to", "close", "closing" or other similar such expressions when discussing the operation of the pinching surfaces of the pincers according to aspects of the invention. It should be understood that the pinching surfaces must be close enough to trap hairs without cutting them before the hairs are uprooted, but do not need to necessarily contact each other specifically to effect such pulling. No attempt at distinguishing between the different sets of terms is intended and they are used synonymously herein.

As used herein below, the terms "interlock" and "engage" and words derived therefrom will be used interchangeably in relation to the rotation-transferring protrusion of a disk and its receiving recess on another adjacent disk according to aspects of the invention. No attempt at distinguishing between the different sets of terms will be made.

Reference is now made to the embodiment shown in FIG. 1 which shows an exploded view of a depilator assembly 10 constructed according to an embodiment of the present invention. The depilator assembly 10 in FIG. 1 includes a disk 30 and two pincers 20 and 20'. Each pincer 20 and 20' is constructed linearly and has two arms 22 and 22' joined to a central section 24. In FIG. 1, a central section 24 has a generally circular shape. However, in other embodiments, other shapes are also possible.

Extending from central section 24 are two rotatable extensions 26. One pincer 20 is positioned on a first side of a disk 30 while the other pincer 20' is positioned on a second side of the disk 30.

At the end of each arm 22 and 22' is a pinching surface 132. When adjacent pinching surfaces 132 contact each other, best seen in FIGS. 4A and 5 below, the surfaces 132 trap hair which is then torn out by the root while the disk 30 rotates. At the end of each arm 22 and 22' is a trapping element 28 which assists in directing hair toward pinching surfaces 132. However, it is understood that the trapping element 28 need not be used in all aspects of the invention.

The disk 30 may be constructed of metal, plastic, or rubber. Pincers 20 and 20' may be constructed of metal. However, it is understood that the other materials can be used, and that the pincers 20, 20', can include additional materials or films to assist in hair removal.

The disk 30 is integrally formed of two lobes 31 and 31'. Two sets of protrusions 35 and 34 are positioned on the side of the disk 30 shown in FIG. 1. The protrusions 34 and 35 are typically integrally formed with the disk 30, but can be separately attached. As will be better seen when viewing and discussing FIGS. 2A, 2B, 3A and 3B below, protrusions 35, hereafter called "rotation-transferring protrusions", interlock with the disk 30 of an adjacent depilator assembly 10.

The protrusions 34, hereinafter called "pressure-transferring protrusions", periodically contact and press on the arms 22 and 22' of a pincer 20 belonging to an adjacent depilator assembly 10. As a result, the pincer 20 tilts toward a second pincer 20' also associated with the adjacent depilator assembly 10. This tilting is best illustrated below in FIGS. 3B, 4A and 5. As can be noted in FIG. 1, each of the pressure-transferring protrusions 34 extends beyond the plane of the disk 30 and is slightly curved according to an aspect of the invention.

The central section 24 of the pincers 20 and 20' is shaped and sized to be disposed over a projecting hub 38 of the disk 30. There are sized and shaped recesses 37 near the hub 38 into which the rotatable extensions 26 of the pincers 20 and 20' fit, thereby holding the pincers 20, 20' in place. When placed in the recesses 37, rotatable extensions 26 rotate and allow pincers 20 and 20' to tilt. As will be discussed more fully below, the rotatable extensions 26 are positioned collinearly with the axis around which pincers 20 and 20' tilt according to an aspect of the invention.

Figure 5:
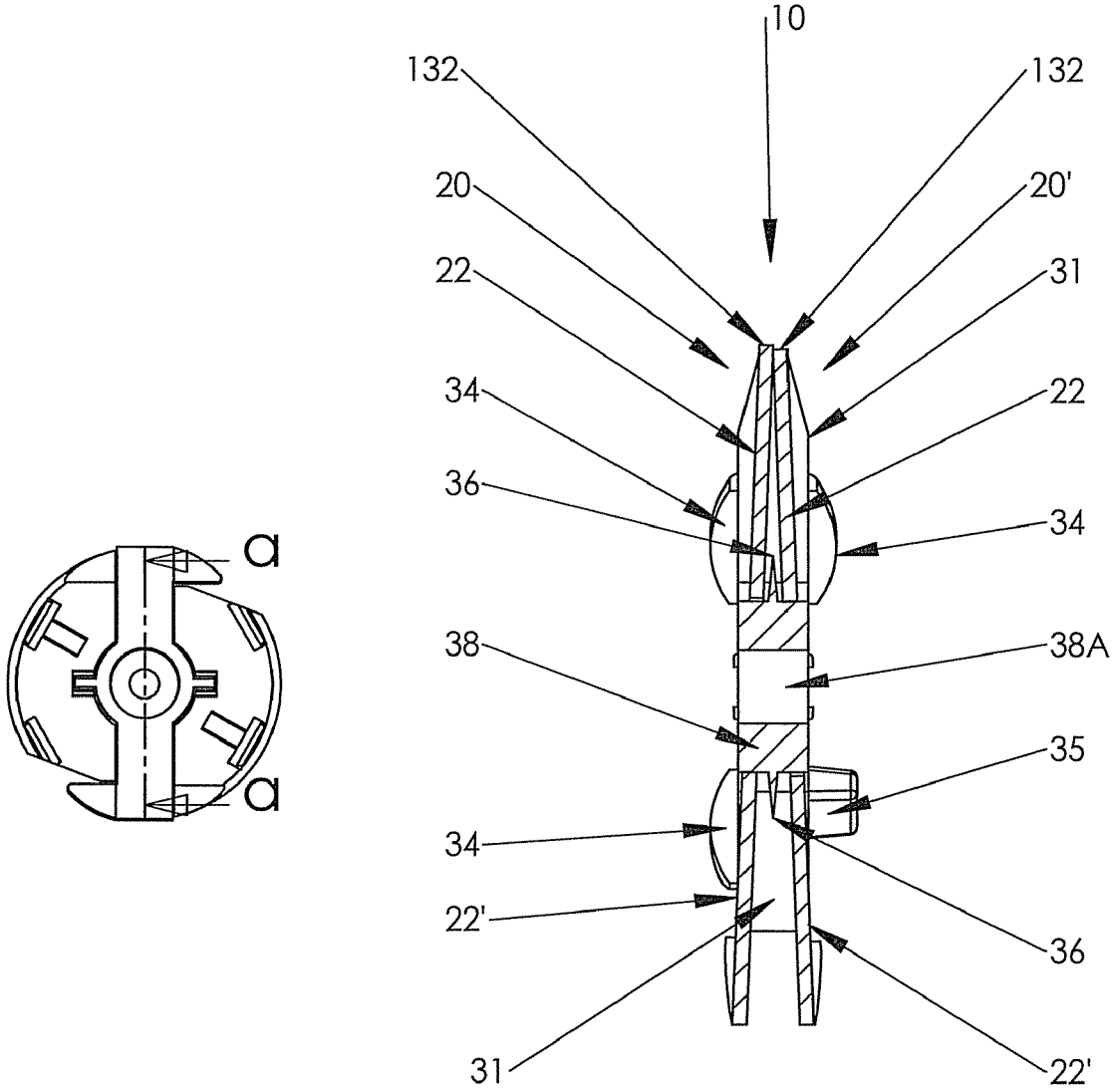
FIG. 5 is a lateral view of the pincers and disk of FIG. 1 during operation FIG. 1.

A projecting hub 38 is sized and shaped to be mounted on a shaft 48 (seen in and discussed in conjunction with FIGS. 6A and 6B below). The shaft 48 is positioned so that the shaft 48 passes through and is substantially perpendicular to the plane of the disk 30. Extending away from projecting hub 38 are slopes 36 in the region between lobes 31 and 31'. The slopes 36 are present on both sides of the disk 30 and extend away from the hub 38 in opposite directions along a common axis. The slopes on both sides of the disk 30 extend away from hub 38 in two directions forming linear ramp-like structures. The ramp-like structures receive pincer 20 or 20' when the pincers 20 or 20' tilt. The construction of the slopes 36 is best seen in FIG. 5 which will be discussed below.

Figure 2A:
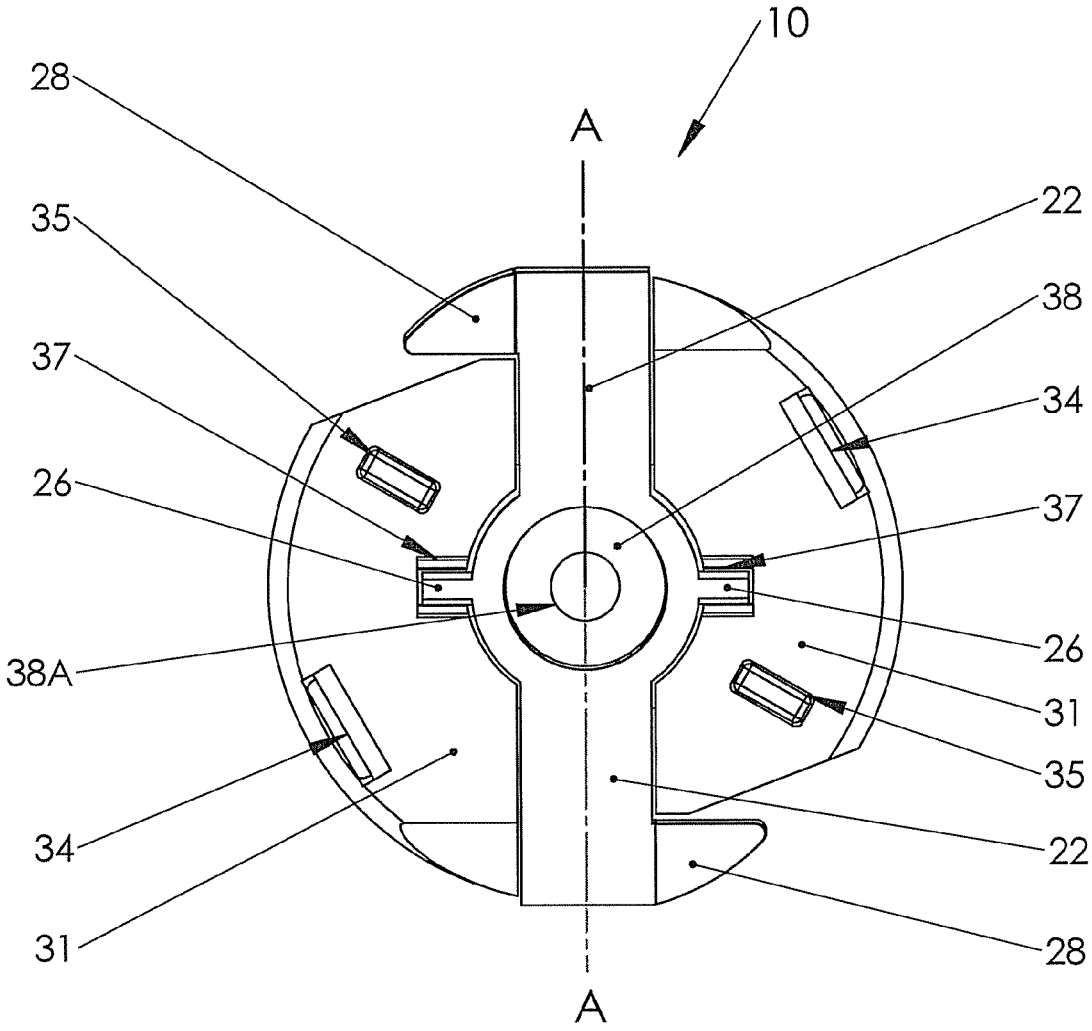
FIGS. 2A and 2B are top and bottom views respectively of the depilator assembly of FIG. 1.
Figure 2B:
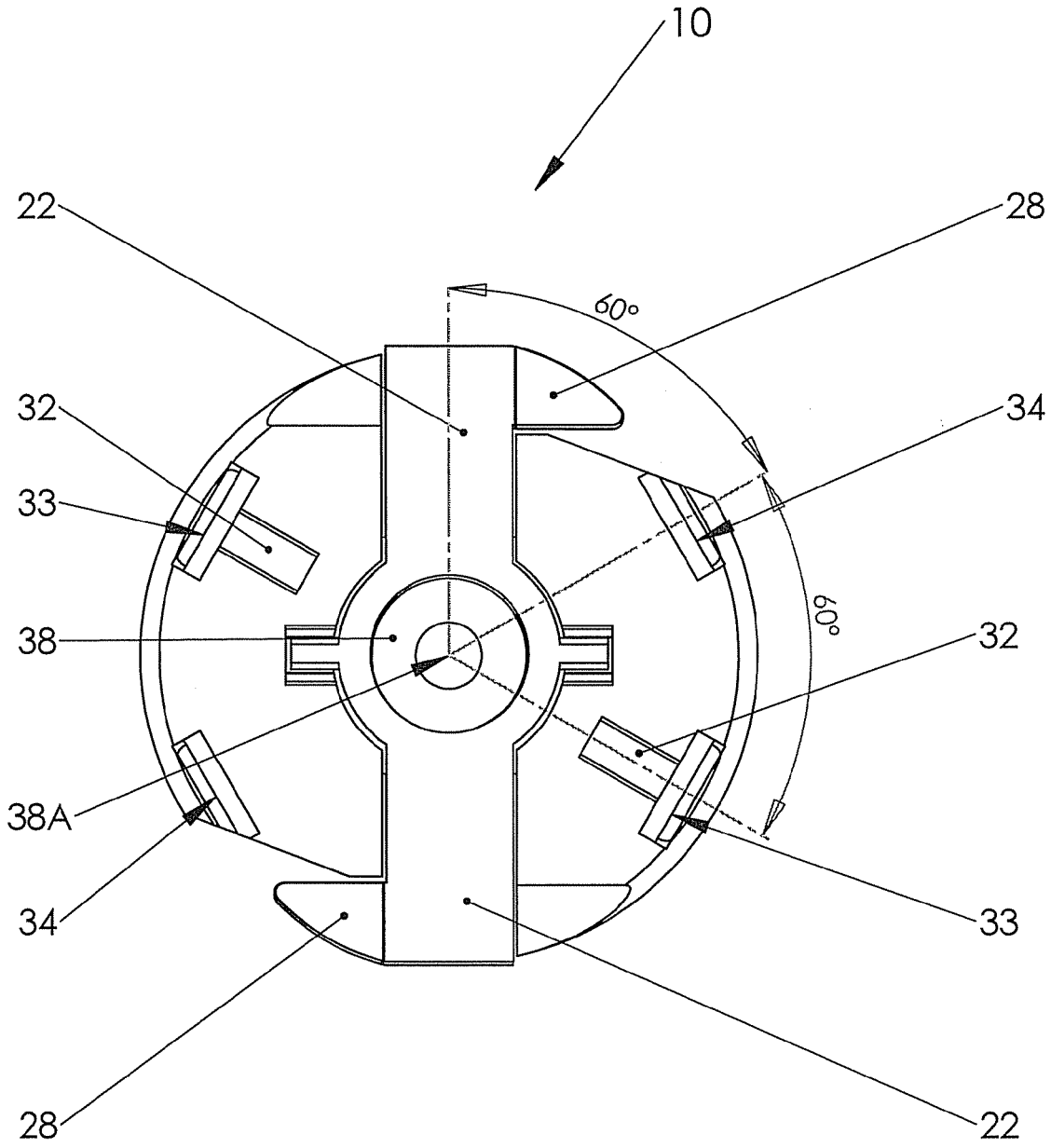

Reference is now made to FIGS. 2A and 2B in which top and bottom views respectively of the depilator assembly 10 are shown. It is readily noted that the top (FIG. 2A) and bottom (FIG. 2B) surfaces of the disk 30 of the depilator assembly 10 are not identical in the shown embodiment. The top surface (FIG. 2A) includes two pressure-transferring protrusions 34 and two rotation-transferring protrusions 35. On the bottom surface shown in FIG. 2B, there are two pressure-transferring protrusions 34, two spacing elements 33 and two recesses 32. However, while shown as not identical, it is understood that the top and bottom surfaces could be made identical according to an aspect of the invention.

The recesses 32 receive and engage with the two rotation-transferring protrusions 35 of an adjacent disk 30 belonging to an adjacent depilator assembly. As will be described below, this interlocking structure assists in transferring rotational motion between adjacent depilator assemblies 10 in the plurality of the depilator assemblies 10 positioned in a shaving head 49 (shown in FIGS. 6A, 6B, and 7). The axis of rotation of the depilator assembly 10 is substantially perpendicular to the plane of the paper in FIGS. 2A and 2B and proceeds through a hole 38A in the projecting hub 38.

Figure 3A:
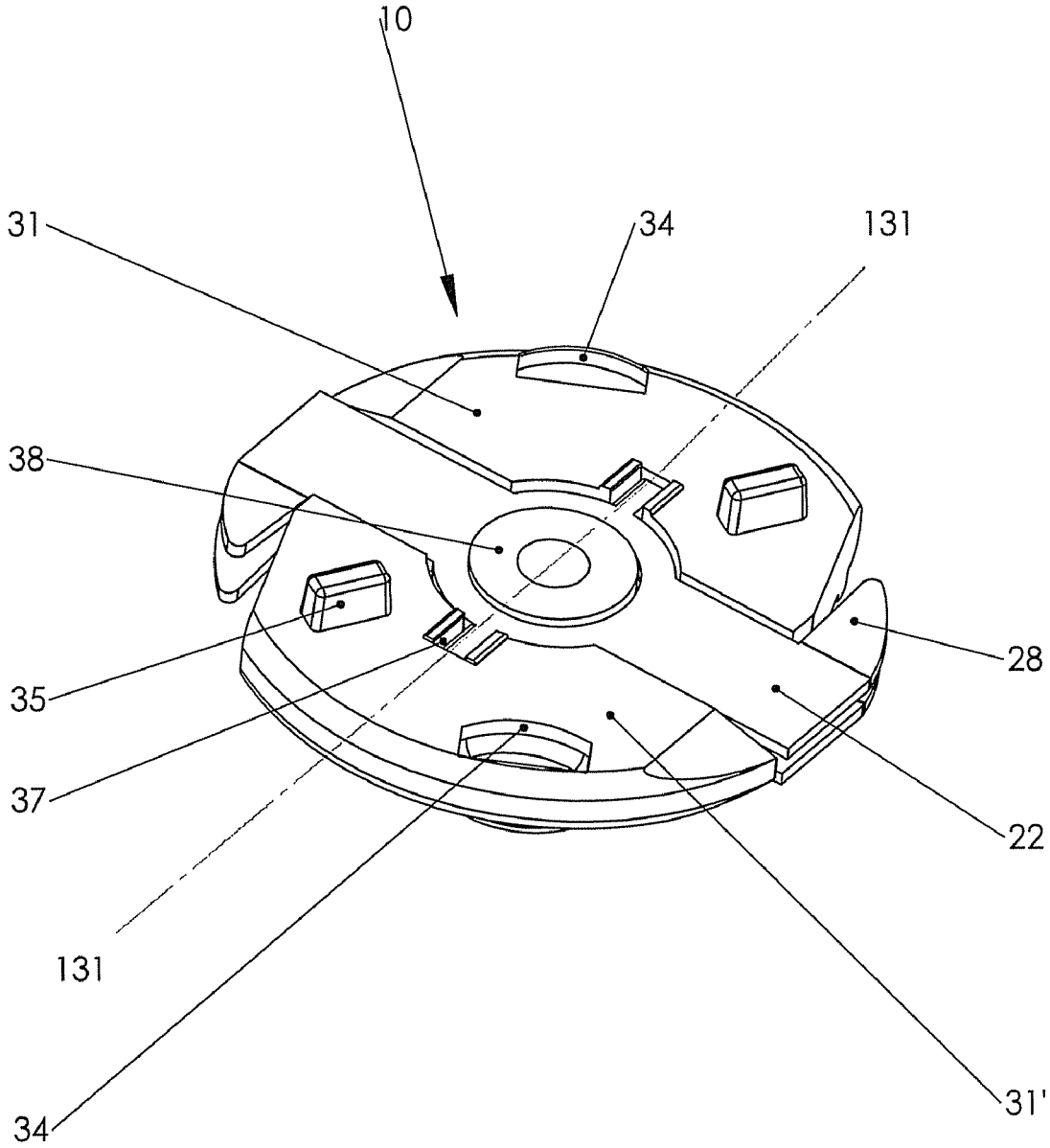
FIGS. 3A and 3B are side-top and side-bottom views respectively, showing the depilator assembly of FIG. 1.
Figure 3B:
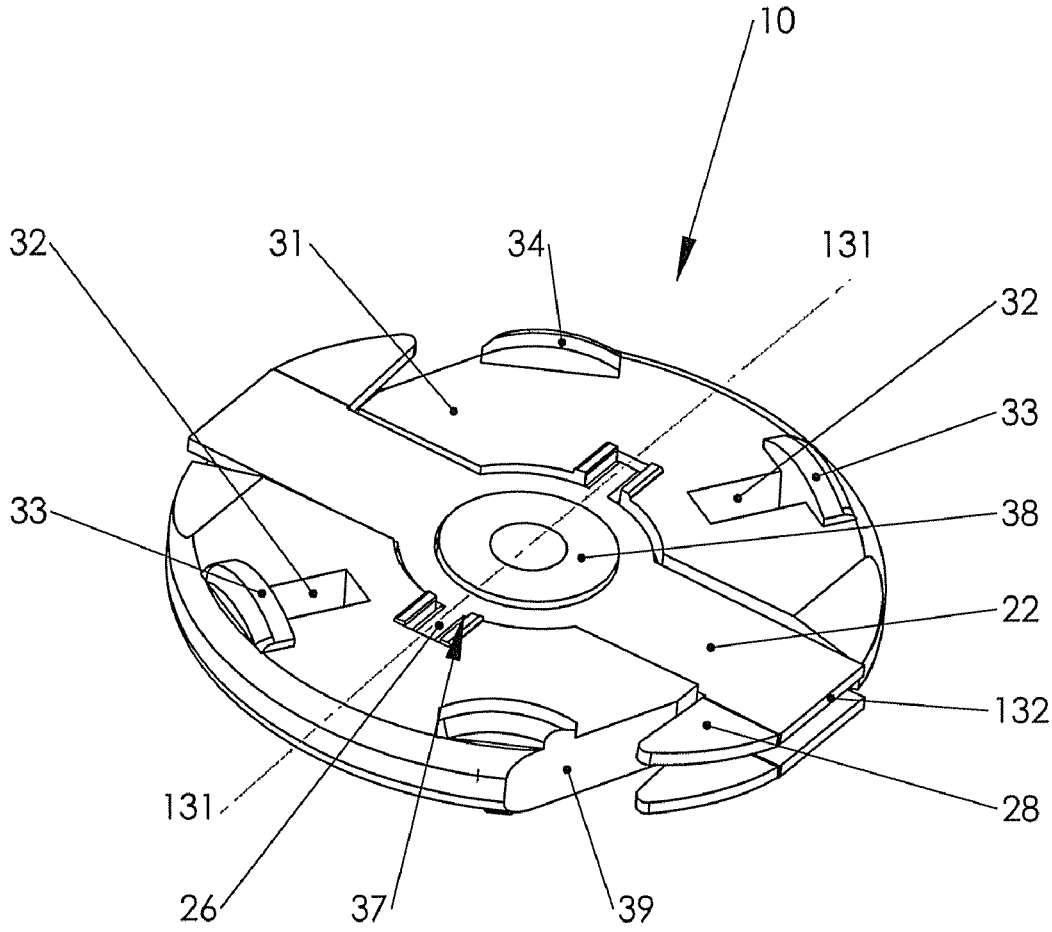

FIGS. 3A and 3B to which reference is now made are two isometric, side-top and side-bottom views respectively, of the depilator assembly 10 constructed as described above in conjunction with FIGS. 2A and 2B. FIGS. 3A and 3B correspond to side views of the views shown in FIGS. 2A and 2B respectively. The elements in FIGS. 3A and 3B, as well as their operation, have been discussed in conjunction with FIGS. 1 through 2B above, and accordingly, their description will not be repeated.

It should be noted that while lobes 31 and 31' of the disk 30 are generally identical. The lobes 31, 31' are not symmetrical when reflected along a plane running through hub 38 and recesses 37. The lobes 31, 31' are also not symmetrical when reflected along a plane running through hub 38 and slopes 36. This is a result, inter alia, of the positioning and number of protrusions 34 and 35, elements 33, recesses 32 and the truncated edges 39 of lobes 31 and 31', the need for the latter being obvious when viewing FIG. 2B discussed above. However, it is understood that additional configurations are possible, and that the lobes 31, 31' could be identical in aspects of the invention.

Figure 4A:
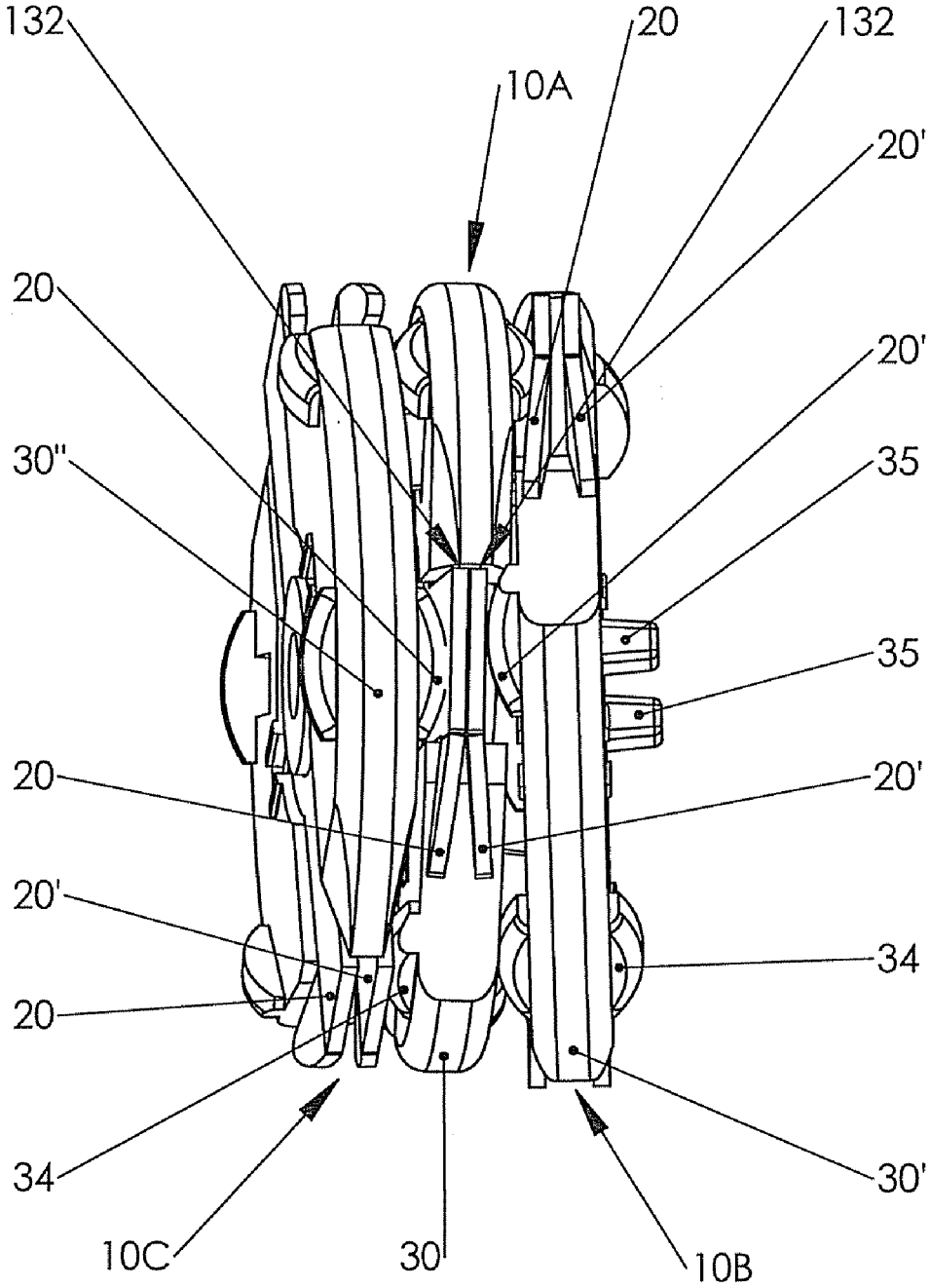
FIG. 4A is a lateral view of a stack of three interlocking depilator assemblies of FIG. 1.
Figure 4B:
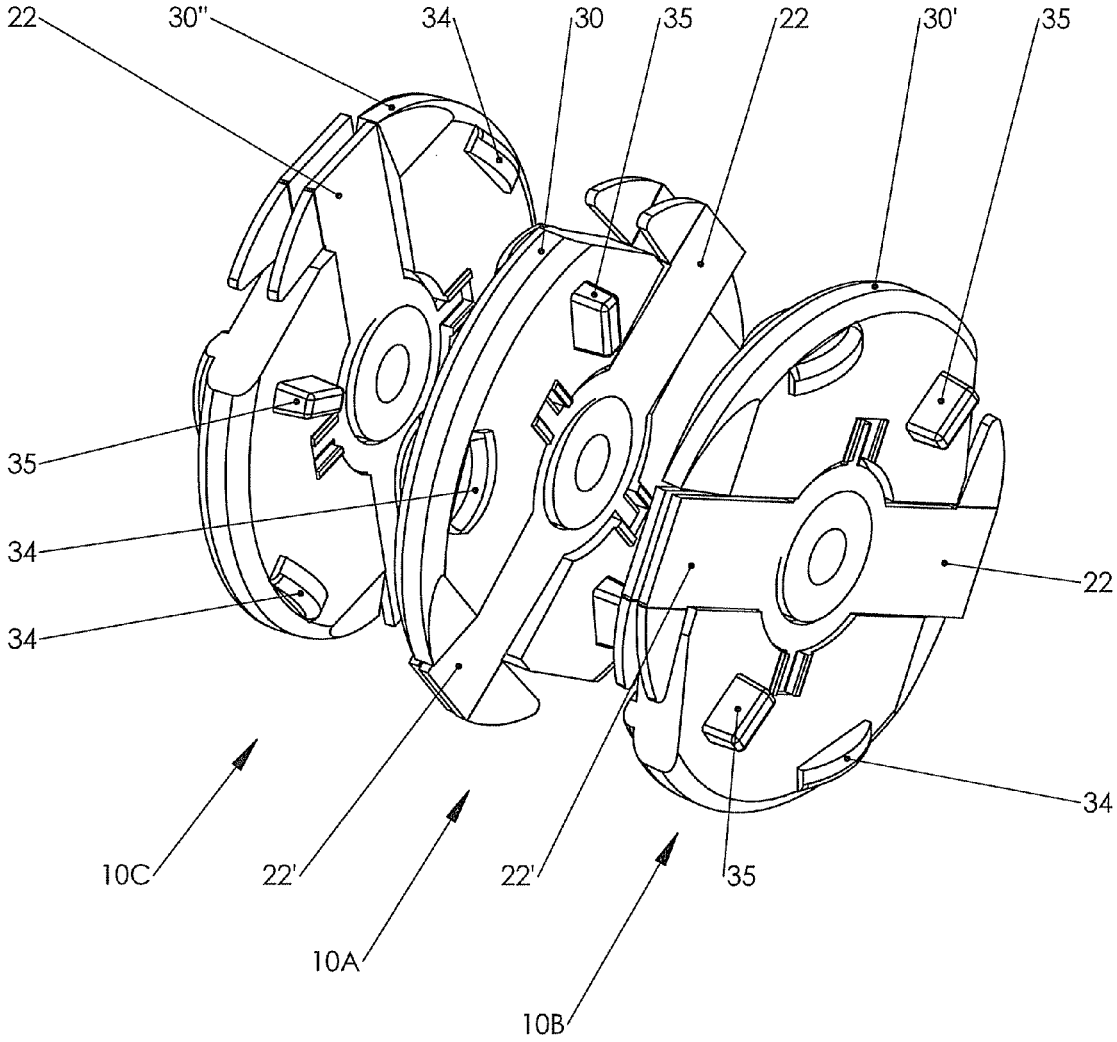
FIGS. 4B and 4C are exploded views of the depilator stack shown in FIG. 4A.
Figure 4C:
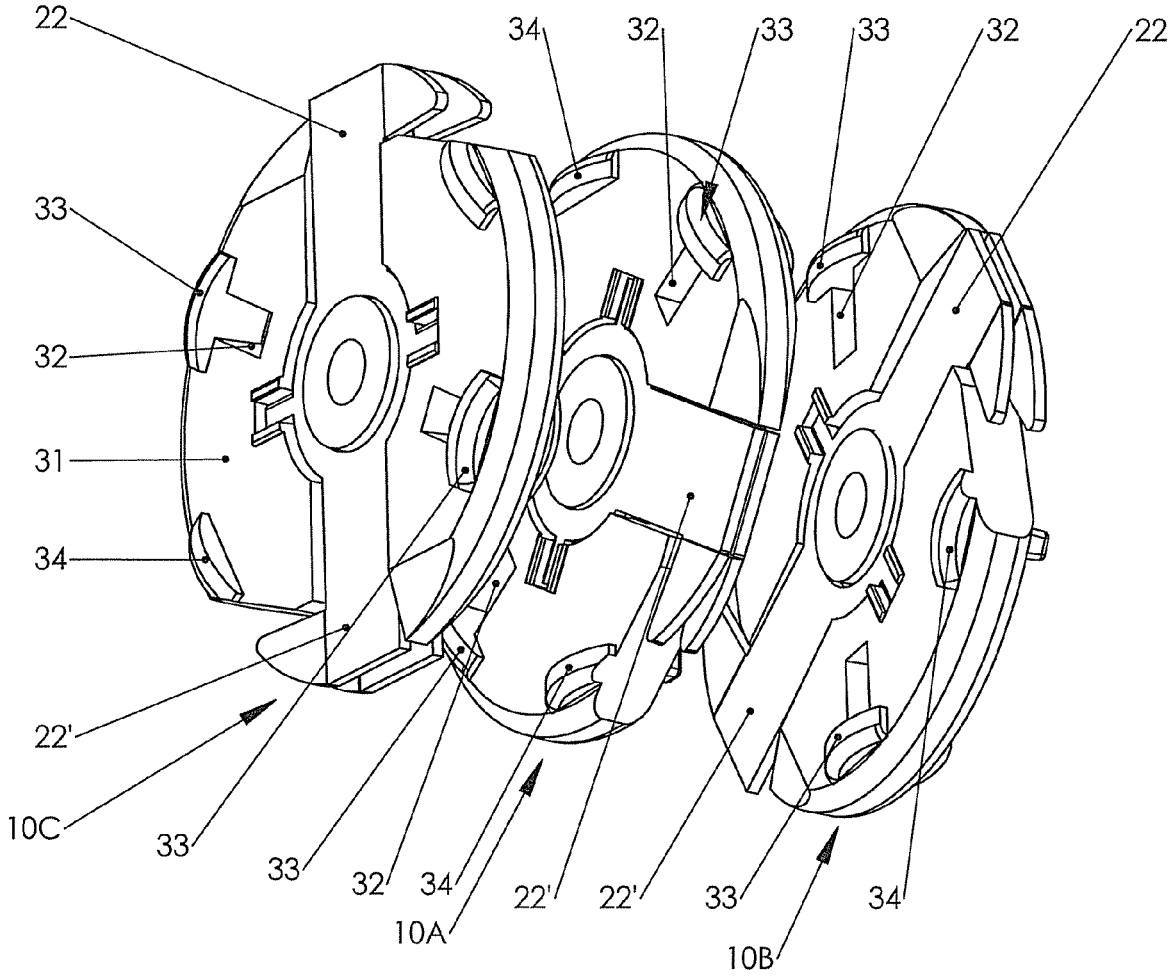

Reference is now made to FIG. 4A which shows a stack of three interlocking depilator assemblies 10A, 10B and 10C. Each assembly 10A, 10B and 10C includes a corresponding disk 30, 30' and 30" and a corresponding pair of the pincers 20 and 20'. Reference is also being made to FIGS. 4B and 4C which represent exploded views of FIG. 4A as viewed from the two sides of the disks 30, 30' and 30". The disks 30, 30' and 30" and pincers 20, 20' are constructed as shown and described in conjunction with FIG. 1.

FIG. 4A shows how the pinching operation is effected and how a hair may be trapped between contacting pinching surfaces 132 when two pincers 20 and 20' on a single assembly 10A are made to tilt toward each other. As pressure-transferring protrusions 34 of the disk 30" contact proximate pincer arms 22 and 22', they cause the arms 22 and 22' of the disk 30 to move toward each other. This can be understood by viewing FIGS. 4B and 4C. Pincer arms 22 and 22' of the pincers 20 and 20' contact each other at flattened pinching surfaces 132 (FIG. 4A), where hair is trapped. The trapped hair is then torn from its roots and removed by a torque operating on rotating depilator assembly 10A. The torque is generated by a motor 47 as discussed below in relation to FIG. 6A.

It should be noted that the pincers 20 and 20' which contact each other, both belong to a single depilator assembly 10A (FIG. 4A), while the pressure-transferring protrusions 34 belong to disks 30' and 30" of adjacent depilator assemblies 10B and 10C respectively. A pressure-transferring protrusion 34 on a side of the disk 30' opposite the disk 30 presses on one pincer arm 22 of the pincer 20' of the disk 30 while a pressure-transferring protrusion 34 on a side of the disk 30" opposite the disk presses on a pincer arm 22 of the pincer 20 of the disk 30. The pincer arms 22 and 22' are visible in FIGS. 4B and 4C but are not visible in FIG. 4A.

FIGS. 4A and 4B show that a second side of the disk 30' of the depilator assembly 10B facing away from the disk 30 contains rotation-transferring protrusions 35. Two recesses 32 are located on a second side of the disk assembly 10B, visible in FIG. 4C. These recesses 32 engage with rotation-transferring protrusions 35 on a side of the adjacent depilator assembly 10A facing the disk assembly 10B. On the second surface of the disk 30 of the depilator assembly 10A facing the disk 30" are two recesses 32 as shown in FIG. 4C. These recesses interlock with rotation-transferring protrusions 35 in FIG. 4B on the side of the disk 30" of the depilator assembly 10C facing the disk 30. On the second side of the disk 30" of the depilator assembly 10C are two recesses 32 (FIG. 4C) which interlock with yet another depilator assembly (not shown). The interlocking of adjacent depilator assemblies 10A-10C allows for the smooth transfer of rotational motion provided by the motor 47 and gear drive 46 along a series of interlocked depilator assemblies 10 positioned in the shaver head 49 as shown in FIG. 6A. This transfer will be further discussed below in conjunction with FIGS. 6A and 6B.

The rotation-transferring protrusions 35 are positioned and spaced on the disks 30, 30' and 30" in a manner which ensures that the pincers of adjacent stacked depilator assemblies 10A, 10B and 10C are properly offset one from another. In FIGS. 4A, 4B and 4C the pincers of the stack are spaced apart at an angle of 60°. Generally, this allows for more pincers than in the prior art. Accordingly, the rate of depilation is faster.

In FIG. 4C, two spacing elements 33 are shown. These spacing elements 33 are positioned on a side of the disks 30, 30' and 30" which includes the recesses 32. The spacing elements 33 function as spacers between adjacent disks 30 and aid in preventing maintenance problems resulting from deposits of hair, dirt, oil etc. which may accumulate during use. Moreover, the spacing elements 33 function as pivots around which disks 30 may tilt as a result of pressure exerted by a spring 45 shown in FIGS. 6A and 6B. Because the spring 45 is positioned so as to exert more pressure on the top of the disks 30 than on the bottom, the disks 30 periodically tilt around element 33 as they rotate. The position of spacing elements 33 is such that the periodic tilt of the disks 30 is synchronized with pressure-transferring protrusions 34 being aligned to press on pincers 20 and 20'. The synchronization is such that pincers 20 and 20' are brought to their closed position when they are near the portion of shaving head 49 (as seen in FIGS. 6A, 6B and 7) exposed to a dermal region having hairs to be uprooted. However, where the spring 45 exerts a more balanced pressure or where they are otherwise not desired, it is understood that the spacer elements 33 need not be used in all aspects of the invention.

Reference is now made to FIG. 5 where a lateral view of adjacent pincers 20 and 20' related to disk assembly 10 are shown. FIG. 5 is presented along line A-A shown in FIG. 2A. As discussed above, adjacent pincers 20 and 20' are operative to uproot a hair when pinching surfaces 132 are brought close to each other as shown in FIG. 5. The pincers 20, 20' tilt around an axis 131 shown in FIGS. 3A and 3B which runs through recesses 37. In the shown embodiment of the present invention, no edge is required for tilting the pincers 20, 20'. The pincers 20, 20' are tilted along slopes 36 which extend away from projecting hub 38. As shown, the slopes 36 meet at a point and have triangular profile. However, it is understood that the slopes 36 can have other profiles or be truncated so as to not meet at a point according to aspects of the invention. As described, tilting occurs when pressure-transferring protrusions 34 of an adjacent depilator assembly 10 press on pincer arm 22 of the pincer 20 (or alternatively the arm 22 of the pincer 20'). The view in FIG. 5 corresponds to closed pincers 20 and 20' shown in FIG. 4A with pinching surfaces 132 proximately positioned. As can be seen, the pivot of the pincers 20, 20' about extensions 26 allow the arms 22 to come together while the arms 22' go apart. The arms 20, 20' do not contact the slopes 30 as shown in FIG. 5, and therefore do not bend.

Figure 6A:
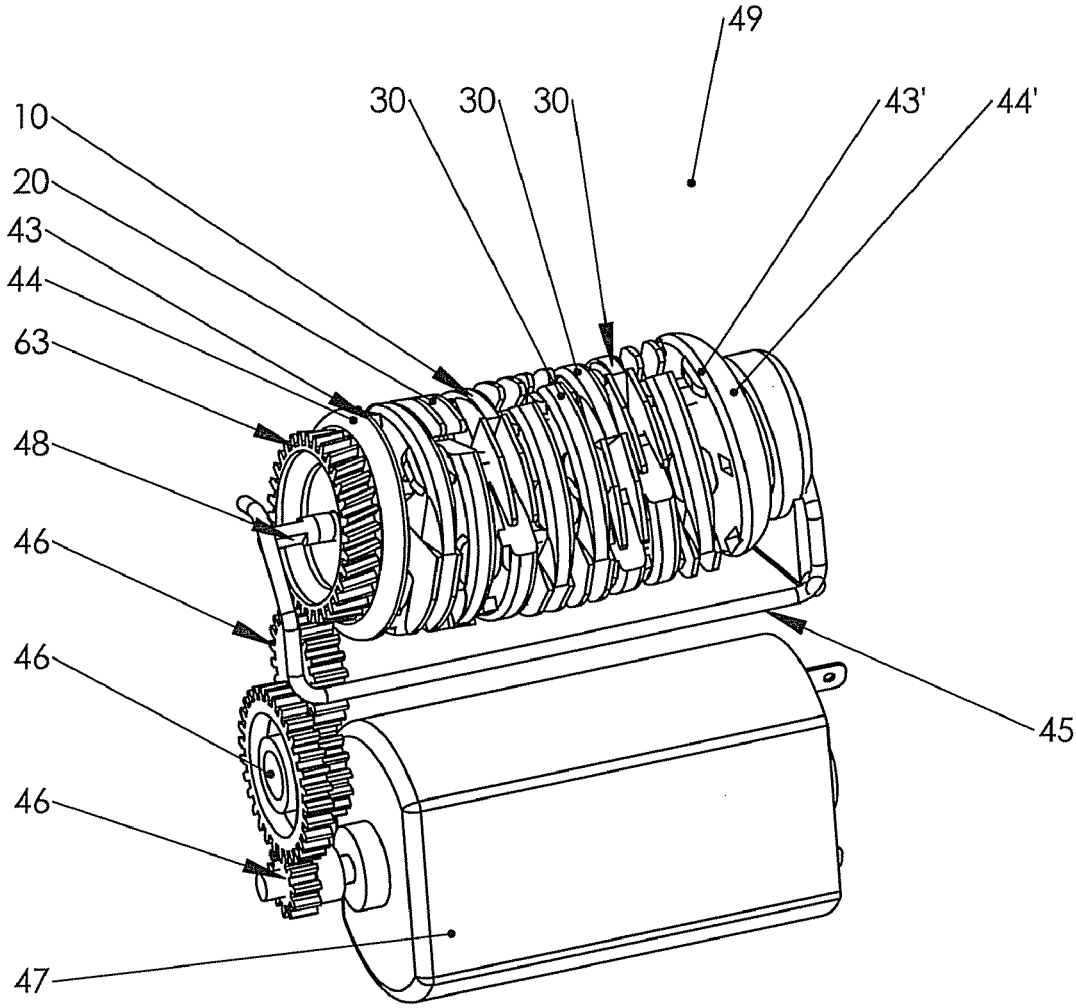
FIG. 6A is an isometric view of a shaving head including a plurality of the depilator assemblies of FIG. 1.
Figure 7:
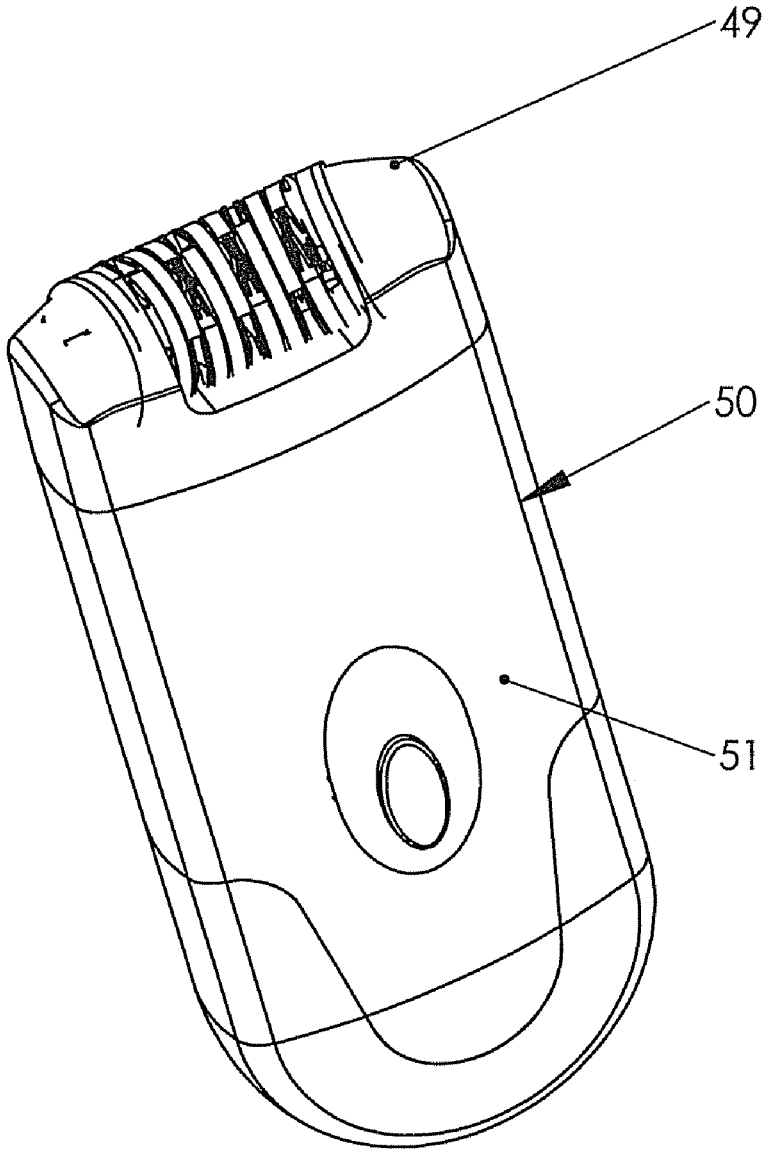
FIG. 7 is a cut-away view of a shaver constructed using the shaver head illustrated in FIGS. 6A-6B.

FIG. 6A, reference to which is now made, shows the shaving head 49 including a plurality of the depilator assemblies 10 having pincers 20, constructed as illustrated in FIGS. 1-5 and described in conjunction therewith according to an aspect of the invention. The shaving head 49 includes a stack of nine depilator assemblies 10. While the shown number of depilator assemblies 10 (i.e., nine) is typical, the number is merely exemplary and non-limiting such that other numbers can be used according to aspects of the invention. The stack is an expansion of the three disk stack in FIGS. 4A-4C. The depilator assemblies 10 are attached to the shaft 48 and are activated by the motor 47 through the gear drive 46. The shaft 48 is received within the central openings 38A (see FIGS. 2A-2B) of the disks 30 in the depilator assemblies 10. The biasing spring 45 holds the engaged individual depilator assemblies 10 tightly together, reinforcing the protrusion-recess engagement mechanism 35, 32 described above in conjunction with FIGS. 4A-4C.

The gear drive 46 serves to convert the rotational speed generated by the motor 47 to the rotational speed required by the depilator assemblies 10. It is readily evident to one skilled in the art that any of many different known gear drives may be used, and that motors of multiple types can be used. Moreover, where the motor so allows, the gear drive 46 need not be used.

There are two pressure disks 44 and 44' at the ends of shaving head 49 which transfer the pressure exerted by spring 45 to the depilator assemblies 10 in the shown embodiment. Between the pressure disks 44 and 44' and the plurality of the depilator assemblies 10 are two pressure bearings 43 and 43'. The bearings 43 and 43' allow the series of the depilator assemblies 10 to rotate relative to the disks 44 without degrading disks 44 and 44'. The bearings 43, 43' also assist in transferring pressure from the spring 45 and the pressure disks 44 and 44' to depilator assemblies 10. Both the pressure disks 44 and 44' and pressure bearing 43 and 43' are positioned around the shaft 48.

As readily seen in FIG. 6A, the spring 45 is positioned on an upper side of the depilator assemblies 10. Thus, the spring 45 subjects the upper side of the depilator assemblies 10 to greater pressure than the other side (i.e., the bottom side). Such pressure asymmetry assists in transferring the forces from spring 45 to the pressure disks 44 and 44' and the pressure bearings 43 and 43' to the series of the depilator assemblies 10 in a fashion which causes the pressure-transferring protrusions 34 to periodically press on pincers 20 and 20' of a depilator assembly 10 forcing them to come together. As mentioned previously, spacing elements 33 act as a pivot on which disks 30 tilt allowing pressure-transferring protrusions 34 to periodically press on pincers 20 and 20'. However, it is understood that other mechanisms can be used to induce such movement of the protrusions 34.

Figure 6B:
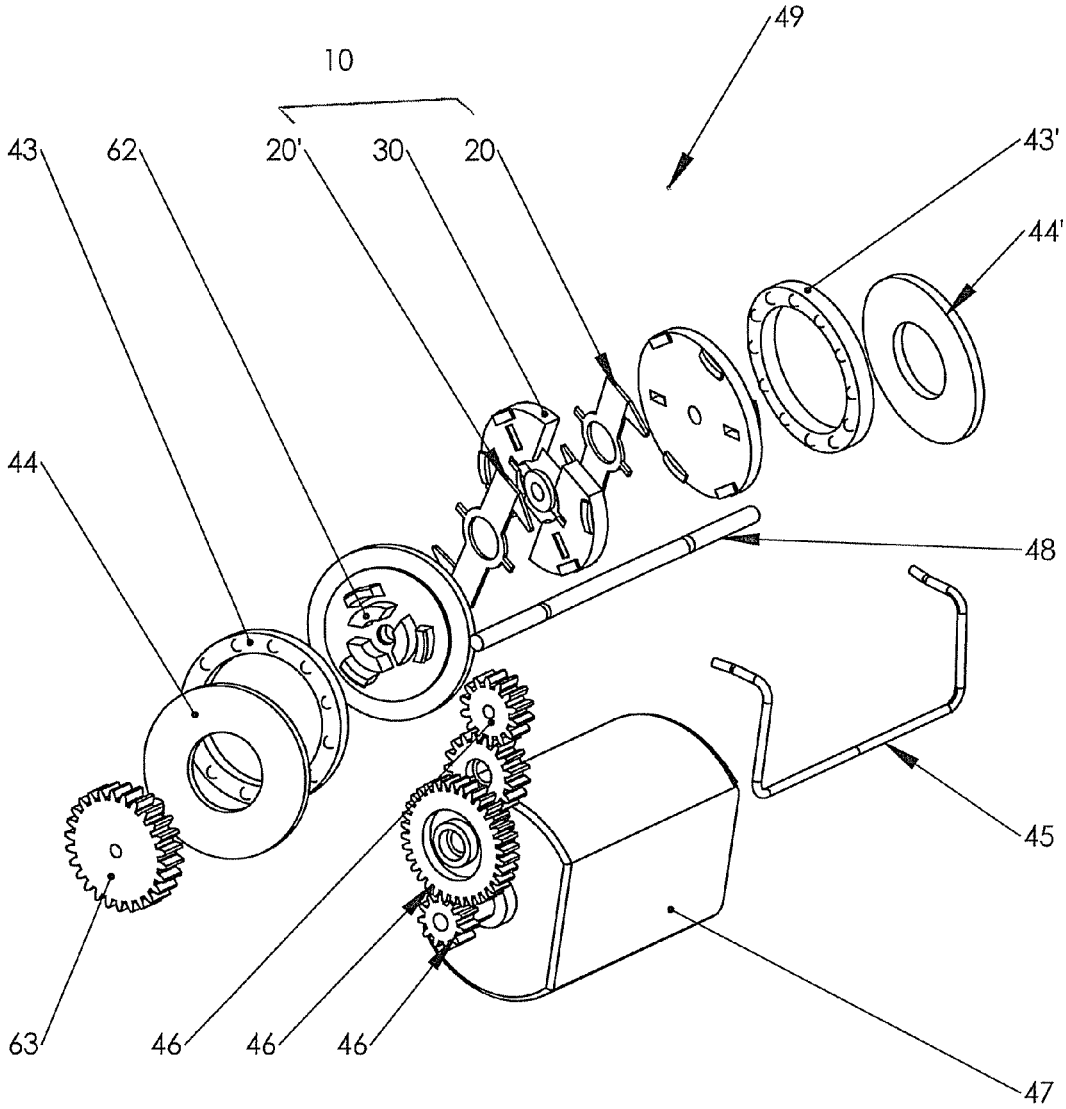
FIG. 6B is an exploded view of the shaver head shown in FIG. 6A.

FIG. 6B, to which reference is now made, shows an exploded view of the shaving head 49 shown in FIG. 6A. For simplicity, only one complete depilator assembly 10 is shown. The disk 30 closest to topmost gear 63 has projections 62 on its side proximate to topmost gear 63. These projections 62 interlock with recesses (not shown) on gear 63 allowing the transfer of rotational motion from gear drive 46 to the series of engaged depilator assemblies 10 in shaving head 49.

The motor 47 in FIGS. 6A and 6B may be of any suitable type known to those skilled in the art. As with other electric shavers, the motor 47 may be operated using any convenient power source, such as house current and/or a battery (not shown) according to an aspect of the invention.

When the electric motor 47 is energized, the shaving head 49 is manipulated to move across a dermal area having hair to be removed. As the series of interlocked depilating assemblies 10 is rotated by electric motor 47, the pressure-transferring protrusions 34 (not shown) periodically and synchronously press on the pairs of the pincers 20 and 20' of the several depilator assemblies 10 included in the shaving head 49. The protrusions 34 bring the pinching surfaces 132 (in FIG. 5) of the pincers 20 and 20' close to each other, thereby trapping hair located between them.

Reference is now made to FIG. 7 which shows a view of a shaver 50 partly exposing the shaving head 49 constructed as in FIGS. 6A and 6B. The motor 47, gear drive 46, spring 45, pressure disks 44 and 44', and pressure bearings 43 and 43' shown in FIGS. 6A and 6B are not visible in FIG. 7 as they are included in a grippable housing 51. It is readily understood by one skilled in the art that the housing 51 may be constructed in any of many different shapes using any of many materials known to those skilled in the art, and is not limited to the shown housing 51.

Figure 8:
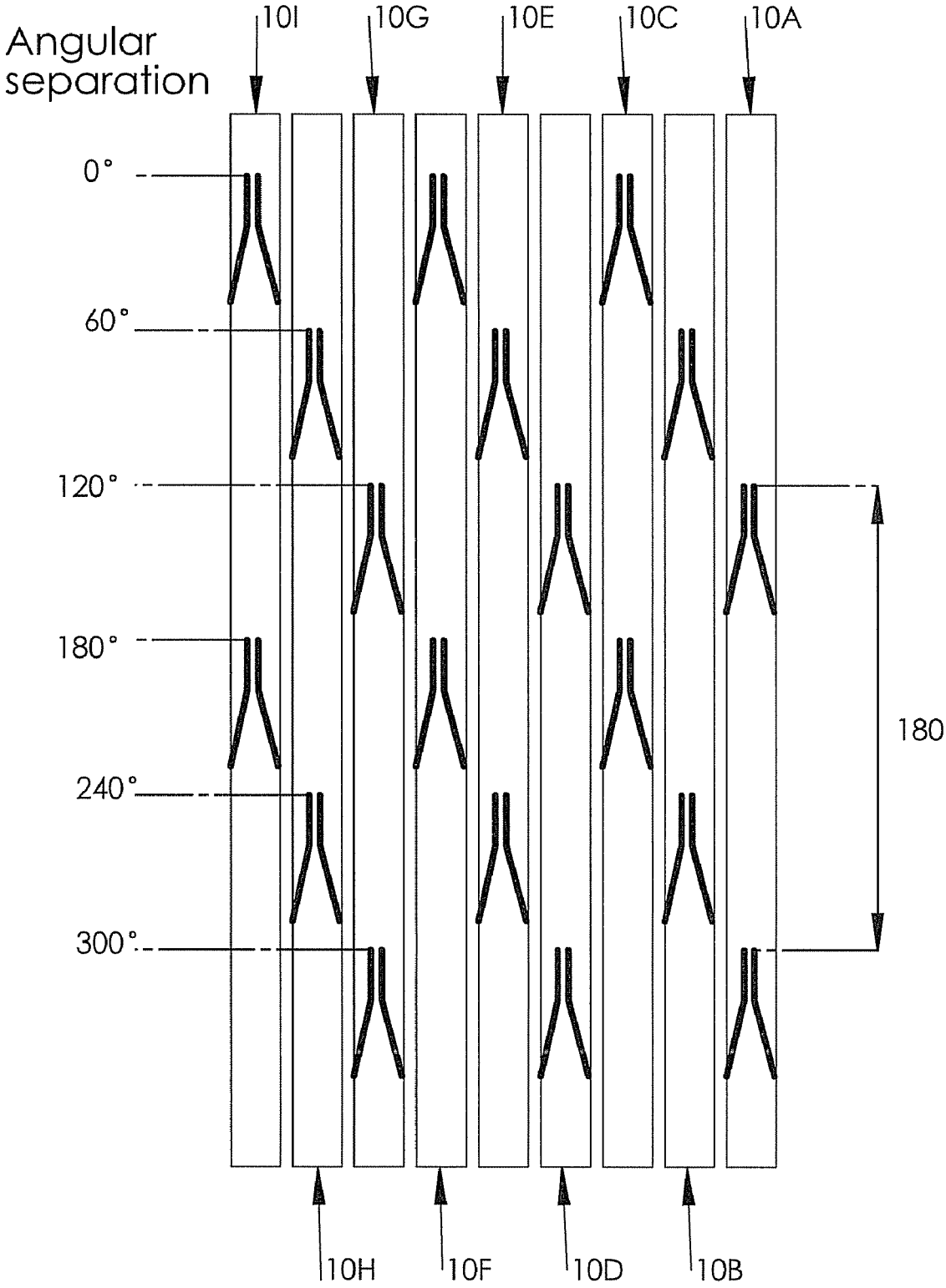
FIG. 8 is a view of a stack of depilator assemblies of FIG. 1 showing the angular positioning of pressure-transferring protrusions in the stack.

The pincers 20, 20' of a stack of the depilator assemblies 10, constructed according to an aspect the present invention, are spaced apart by 60°. This spacing is shown in FIG. 8 to which reference is now made. FIG. 8 includes a stack of nine depilator assemblies 10A-101, atypical. but non-limiting, number. Each disk 30 in the stack is schematically set out linearly with the location of the pincers 20, 20' identifiable. The depilator assembly triads shown in FIG. 8 are equivalent to a dyad of assemblies each having pincers of three arms known in conventional devices. But because the present invention allows an extra depilator assembly 10, the span covered by the present invention's triad exceeds that of a prior art dyad when the disk thickness is the same in both cases. Using the triad configuration of the shown embodiment of the present invention increases the' probability of encountering a hair for uprooting by 50% over conventional devices.

As described above, the axis (item 131 in FIGS. 3A and 3B) used to tilt pincers 20 is in the plane of the disk 30, and runs through the projecting hub 38 and the recesses 37. Because the distance between the tilting axis and the point of contact (i.e. the pinching surfaces 132) of pair of the pincers 20, 20' is relatively long and because no edge is required for pivoting, the pincers 20, 20' in the present invention contact each other more precisely than do pincers in conventional assemblies. The resulting shave is closer than with prior art assemblies and shavers, and shaving is less painful.

In the above embodiment, the shaft 48 is an essentially linear shaft. In another embodiment, the shaft 48 may be an arcuate shaft according to another aspect of the invention. This arcuate shaft 48 could be used with or without spring 45 shown in FIG. 6A. Because a fixed number of the depilator assemblies 10 are present, the assemblies 10 are invariably brought closer together on the concave side of the arc than on the convex side of the arc. This closer positioning on the concave side brings pressure-transferring protrusions 34 into contact with pincers 20 of an adjacent assembly forcing them into their closed, i.e. contacting, position. The assemblies 10 open when the pincers 20, 20' are on the convex side of the arc.

Figure 9A:
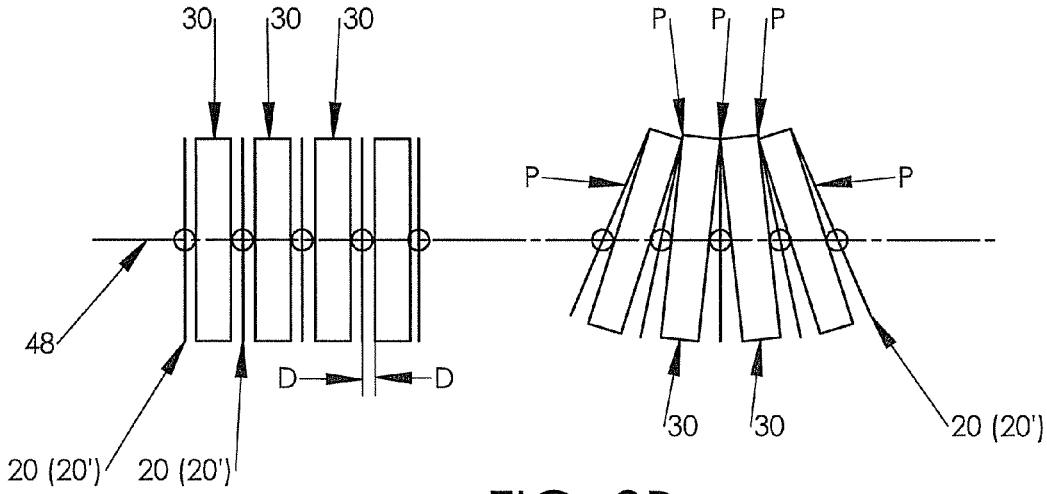
FIG. 9A is a view of the operation of a stack of disk assemblies constructed according to an aspect of the present invention.
Figure 9B:
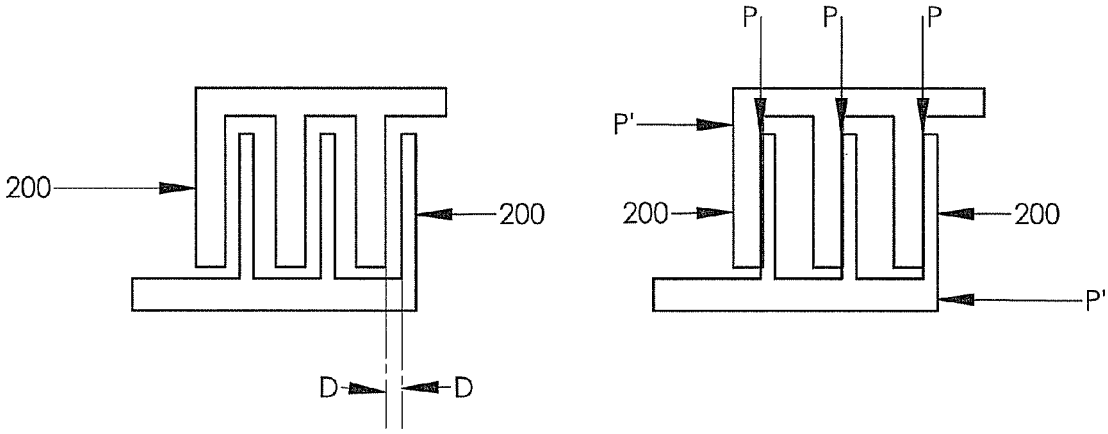
FIG. 9B (PRIOR ART)
FIG. 9B are views of the operation of a conventional depilator.

FIGS. 9A and 9B are now introduced. FIG. 9A shows the effect of force P generated by spring 45 on a series of the depilator assemblies 10. The force P is operative on the top of disk assemblies 10 causing the distance D between adjacent assemblies 10 to increase at the bottom and decrease at the top of the disks. This can be contrasted with the conventional depilator device shown in FIG. 9B which requires forces P' operative at both the top and the bottom of the mechanism. Moreover, the magnitude of the force required to bring together depilating elements 200 in FIG. 9B is larger than the force required by the device shown in FIG. 9A to bring together the pincers 20, 20', where the magnitude is a multiple of the disks 200 being tilted. As shown, the force P' is three times the P (i.e., 3P). However, since the pincers 20, 20' rotate about the axis, 31, less force is required as compared to that required in the devices shown in FIG. 9B.

A shaver employing depilator assemblies constructed according to an aspect of the present invention uses a larger number of the disks for a given distance along the shaving head than in prior art. As a result of the extra disks, each pincer when closing needs to move through a shorter arc than do pincers of conventional assemblies. A shorter arc requires decreased acceleration on the part of the moving pincers (see FIG. 9A), resulting, inter alia, in a device producing less noise.

A feature of the present invention is that the pincers of one assembly is activated by the protrusions of adjacent depilator assemblies. The pressure-transferring protrusion and spacer asymmetry of the disks also provide an advantage over conventional devices. Finally, it should be noted that rotary motion is transferred from one disk to another more reliably because the rotation-transferring protrusions 35 are positioned at a greater radius than in prior art assemblies.

While shown as being used in a single head shaver, it is understood that the present invention can be included in units having multiple heads. Moreover, it is understood that any type of hair (human or otherwise) can be pulled using the present invention, and that the present invention can be used to pull any object from a surface.

Although a few embodiments of the present invention have been shown and described, it will be appreciated by persons skilled in the art that the present invention is not limited by what has been particularly shown and described herein above and that changes may be made in this embodiment without departing from the principles and spirit of the invention, the scope of the which is defined by the claims that follow and their equivalents:

What is claimed is:

1. A depilator assembly for trapping hair for removal, said assembly including:

a first disk including a first surface and a sloping region extending into the first surface;

first and second pincers extending from a center of rotation of the first disk and which are tiltably attached to the first disk to tilt about a first axis such that at least a portion of the first pincer is received in the sloping region to periodically contact the second pincer;

a second disk including a second surface and a second pressure-transferring protrusion extending from the second surface, the second disk being biased to press the second pressure transferring protrusion against the first pincer so as to tilt the first pincer about the first axis; and a rotation unit which induces a rotation of the first disk about the center of rotation and induces a rotation of the second disk such that the second pressure-transferring protrusion presses the first pincer to tilt about the first axis, wherein:

each first and second pincer is linear having two arms disposed along a straight line, a plurality of first and second disks is arranged alternately on a shaft, and each pair of first and second pincers is spaced apart on successive disks at a predetermined angle.

2. The depilator assembly of claim 1, wherein the first pincer is received in the sloping region to periodically contact the second pincer without contacting the sloping region.

3. The depilator assembly of claim 1, wherein:

the first disk further includes another surface opposite the first surface into which another sloping region extends, the second pincer tilts about the first axis and is received into the another sloping region so as to periodically contact the first pincer;

the sloping region extends into the first surface at a first angle, and the another sloping region extends into the another surface at another angle so as to define an edge at which the first and another sloping regions meet.

4. The depilator assembly of claim 3, wherein:

the first pincer is received in the sloping region to periodically contact the second pincer without contacting the sloping region, and the second pincer is received into the another sloping region to periodically contact the first pincer without contacting the another sloping region.

5. The depilator assembly of claim 1, wherein:

the first disk further comprises a spacer element extending from the first surface and to define a second tilt axis, and the second disk is biased to press against the spacer element and to tilt about the second tilt axis such that the second pressure transferring protrusion presses against the first pincer so as to tilt the first pincer about the first axis to connect with the second pincer.

6. The depilator assembly of claim 5, wherein:

the first disk comprises another spacer element extending from a surface of the first disk opposite the first surface along the second tilt axis, the assembly further comprises a third disk including a third surface and a third pressure-transferring protrusion extending from the third surface, and the third disk is biased to press against the another spacer element and to tilt about the second tilt axis such that the third pressure transferring protrusion presses against the second pincer so as to tilt the second pincer about the first axis to connect with the first pincer.

7. The depilator assembly of claim 1, wherein:

the first pincer comprises a first arm and a second arm which extend from the center of rotation, the sloping region comprises a first ramp and a second ramp which extend into the first surface from the center of rotation, when the first arm tilts into the first ramp to contact the second pincer, the second arm tilts so as to not be in the second ramp, and when the second arm tilts into the second ramp to contact the second pincer, the first arm tilts so as to not be in the first ramp.

8. The depilator assembly according to claim 1, further comprising an essentially straight shaft.

9. A depilator assembly for trapping hair for removal, said assembly including:

a first disk including a first surface and a spacer element extending from the first surface and to define a second tilt axis;

a first pincer and a second pincer extending from a center of rotation of the first disk and which are tiltably attached to the first disk to tilt about a first axis such that the first and second pincers periodically contact each other;

a second disk including a second surface and a second pressure-transferring protrusion extending from the second surface, the second disk being biased to press against the spacer element and to tilt about the second tilt axis such that the second pressure transferring protrusion presses against the first pincer so as to tilt the first pincer about the first axis to connect with the second pincer; and a rotation unit which induces a rotation of the first disk about the center of rotation and induces a rotation of the second disk such that the second pressure-transferring protrusion presses the first pincer to tilt about the first axis to connect with the second pincer, wherein:

each first and second pincer is linear having two arms disposed along a straight line, a plurality of first and second disks is arranged alternately on a shaft, and each pair of first and second pincers on successive disks is space apart at a predetermined angle.

10. The depilator assembly of claim 9, wherein:

the first disk comprises another spacer element extending from a surface of the first disk opposite the first surface along the second tilt axis, the assembly further comprises a third disk including a third surface and a third pressure-transferring protrusion extending from the third surface, and the third disk is biased to press against the another spacer element and to tilt about the second tilt axis such that the third pressure transferring protrusion presses against the second pincer so as to tilt the second pincer about the first axis to connect with the first pincer.

11. The depilator assembly of claim 9, wherein:

the spacer element comprises a curved portion such that the second disk rocks on the curved portion to tilt about the second axis.

12. The depilator assembly of claim 9, further comprising a spring which biases the first and second disk so as to press the second pressure-transferring protrusion against the first pincer.

13. The depilator assembly of claim 9, further comprising a biasing element which provides a biasing force at a location at a radial distance away from the center of rotation, wherein:

the first pincer comprises a first arm and a second arm which extend from the center of rotation, and when the biasing force is applied to the second pressure-transferring protrusion when the second pressure-transferring protrusion is at the location, one of the first and second arms tilts to contact the second pincer and the other of the first and second arms tilts away from the second pincer.

14. The depilator assembly according to claim 9, further comprising an essentially straight shaft.

* * * * *